US009376886B2

(12) United States Patent
Acosta et al.

(10) Patent No.: US 9,376,886 B2
(45) Date of Patent: Jun. 28, 2016

(54) MULTIPLE RAMP COMPRESSION PACKER

(71) Applicant: Halliburton Energy Services, Inc., Houston, TX (US)

(72) Inventors: Frank V. Acosta, Duncan, OK (US); Wesley G. Duke, Duncan, OK (US); Stoney M. Yates, Duncan, OK (US); John Key, Comanche, OK (US); Nicholas Budler, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/695,620

(22) Filed: Apr. 24, 2015

(65) Prior Publication Data

US 2015/0292295 A1 Oct. 15, 2015

Related U.S. Application Data

(62) Division of application No. 13/350,030, filed on Jan. 13, 2012, now abandoned.

(51) Int. Cl.

| | |
|---|---|
| ***E21B 33/128*** | (2006.01) |
| ***E21B 23/06*** | (2006.01) |
| ***E21B 34/14*** | (2006.01) |

(52) U.S. Cl.

CPC ..... *E21B 33/128* (2013.01); *E21B 23/06* (2013.01); *E21B 34/14* (2013.01)

(58) Field of Classification Search

CPC . E21B 33/1208; E21B 33/128; E21B 33/129; E21B 23/06

See application file for complete search history.

(56) References Cited

U.S. PATENT DOCUMENTS

| | | | | |
|---|---|---|---|---|
| 1,883,071 | A | 10/1932 | Stone | |
| 2,925,865 | A * | 2/1960 | Oliver | 166/154 |
| 7,080,693 | B2 * | 7/2006 | Walker et al. | 166/387 |
| 8,167,047 | B2 | 5/2012 | Themig et al. | |
| 8,291,980 | B2 | 10/2012 | Fay | |
| 2003/0127227 | A1 | 7/2003 | Fehr et al. | |
| 2006/0169463 | A1 | 8/2006 | Howlett | |
| 2006/0213656 | A1 * | 9/2006 | Clifton | 166/125 |
| 2010/0101807 | A1 * | 4/2010 | Greenlee et al. | 166/387 |
| 2011/0030975 | A1 | 2/2011 | Duphorne | |
| 2011/0036592 | A1 | 2/2011 | Fay | |
| 2011/0127047 | A1 | 6/2011 | Themig et al. | |

* cited by examiner

*Primary Examiner* — Jennifer H Gay
*Assistant Examiner* — George Gray
(74) *Attorney, Agent, or Firm* — McDermott Will & Emery LLP; John Wustenberg

(57) ABSTRACT

Systems and methods for remotely setting a downhole device. The system includes a base pipe having inner and outer radial surfaces and defining one or more pressure ports extending between the inner and outer radial surfaces. An internal sleeve is arranged against the inner radial surface and slidable between a closed position, where the internal sleeve covers the one or more pressure ports, and an open position, where the one or more pressure ports are exposed to an interior of the base pipe. A trigger housing is disposed about the base pipe and defines an atmospheric chamber in fluid communication with the one or more pressure ports. A piston port cover is disposed within the atmospheric chamber and moveable between blocking and exposed positions. A wellbore device is used to engage and move the internal sleeve into the open position by applying predetermined axial force to the internal sleeve.

14 Claims, 5 Drawing Sheets

MULTIPLE RAMP COMPRESSION PACKER

BACKGROUND

The present invention relates to systems and methods used in downhole applications and, more particularly, to providing a seal in a casing annulus capable of stopping gas migration.

In the course of treating and preparing a subterranean well for production, downhole tools, such as well packers, are commonly run into the well on a conveyance such as a work string or production tubing. The purpose of the well packer is not only to support the production tubing and other completion equipment, such as sand control assemblies adjacent to a producing formation, but also to seal the annulus between the outside of the production tubing and the inside of the well casing or the well bore itself. As a result, the movement of fluids through the annulus and past the deployed location of the packer is substantially prevented.

SUMMARY OF THE INVENTION

The present invention relates to systems and methods used in downhole applications and, more particularly, to providing a seal in a casing annulus capable of stopping gas migration.

In some embodiments, a system for sealing a wellbore annulus is disclosed. The system may include a base pipe having inner and outer radial surfaces and defining an elongate orifice, and an opening seat arranged against the inner radial surface and having a setting pin coupled thereto and extending radially through the elongate orifice, the setting pin being configured to axially translate in a first direction within the elongate orifice as the opening seat axially translates. The system may further include a piston arranged on the outer radial surface and being coupled to the setting pin such that axial translation of the opening seat correspondingly moves the piston, the piston having a piston biasing shoulder, and a lower shoe extending about the outer radial surface and having a mandrel biasing shoulder. The system may also include a packer disposed about the outer radial surface and interposing the piston and the lower shoe, the packer having a first packer element adjacent the piston and a second packer element adjacent the lower shoe, and a wellbore device disposed within the base pipe and configured to engage and move the opening seat, wherein as the opening seat axially translates in the first direction the first and second packer elements are compressed against the piston and mandrel biasing shoulders, respectively, and the first packer element forms a first seal in the annulus and the second packer element forms a second seal in the annulus, and wherein the first and second seals define a cavity therebetween that traps fluid therein and provides a hydraulic seal.

In some embodiments, a method for sealing a wellbore annulus is disclosed. The method may include engaging an opening seat with a wellbore device, the opening seat being movably arranged within a base pipe having inner and outer radial surfaces and defining an elongate orifice, the opening seat further having a setting pin coupled thereto and extending radially through the elongate orifice, and applying a predetermined axial force on the opening seat with the wellbore device and thereby axially moving the opening seat and the setting pin in a first direction. The method may further include moving in the first direction a piston arranged on the outer radial surface, the piston being coupled to the setting pin such that axial translation of the opening seat correspondingly moves the piston, wherein the piston has a piston biasing shoulder, and engaging and compressing a first packer element with the piston biasing shoulder and thereby forming a first seal within the wellbore annulus. The method may also include engaging and compressing a second packer element with a mandrel biasing shoulder and thereby forming a second seal within the wellbore annulus, and forming a hydraulic seal in a cavity defined between the first and second seals.

In some embodiments, a system for sealing a wellbore annulus may be disclosed. The system may include a base pipe having inner and outer radial surfaces and defining an elongate orifice, and an opening seat arranged against the inner radial surface and having a setting pin coupled thereto and extending radially through the elongate orifice, the setting pin being configured to axially translate in a first direction within the elongate orifice as the opening seat axially translates. The system may also include a piston arranged on the outer radial surface and being coupled to the setting pin such that axial translation of the opening seat correspondingly moves the piston, the piston having a piston biasing shoulder, a lower shoe extending about the outer radial surface and having a mandrel biasing shoulder, and a first ramped collar arranged about the base pipe and interposing the piston and the lower shoe, the first ramped collar having a first ramp and an opposing second ramp, and a first biasing shoulder and an opposing second biasing shoulder. The system may further include a first packer element disposed about the base pipe and arranged between the piston and the first ramped collar, a second packer element disposed about the base pipe and arranged between the lower shoe and the first ramped collar, and a wellbore device disposed within the base pipe and configured to engage and move the opening seat, wherein as the opening seat axially translates in the first direction the first and second packer elements are compressed and the first packer element forms a first seal in the annulus and the second packer element forms a second seal in the annulus.

In some embodiments, a system for sealing a wellbore annulus may be disclosed. The system may include a base pipe having inner and outer radial surfaces, a hydrostatic piston arranged within a hydrostatic chamber defined by a retainer element arranged about the base pipe, the retainer element having a retainer shoulder, and a compression sleeve arranged about the base pipe and coupled to the hydrostatic piston with a stem element extending from the hydrostatic piston, the compression sleeve having a sleeve shoulder. The system may also include first and second packer elements arranged about the base pipe and interposing the retainer element and the compression sleeve, and a wellbore device disposed within the base pipe and configured to engage and move an opening seat arranged against the inner radial surface, wherein moving the opening seat triggers a pressure differential across the hydrostatic piston and forces the hydrostatic piston to pull the compression sleeve into contact with the second packer element and the retainer element into contact with the first packer element, and wherein the first and second packer elements are compressed and form first and second seals, respectively, in the annulus and further define a cavity therebetween, the cavity being configured to trap fluid therein and provide a hydraulic seal.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modification, alteration, and equivalents in form and function, as will occur to those skilled in the art and having the benefit of this disclosure.

DETAILED DESCRIPTION

The present invention relates to systems and methods used in downhole applications and, more particularly, to providing a seal in a casing annulus capable of stopping gas migration.

As will be discussed in detail below, several advantages are gained through the systems and methods disclosed herein. For example, the disclosed systems and methods initiate and set a downhole tool, such as one or more well packers or packer elements, in order to isolate the annular space defined between a completion casing and a base pipe (e.g., production string). The set packer is able to create a seal that prevents the migration of fluids through the annulus, thereby isolating the areas above and below. The packer may be set using hydraulic and/or mechanical means, and adjacent packer elements may provide one or more hydraulic seals in the annulus that prevent or otherwise eliminate the migration of gases at elevated pressures. To facilitate a better understanding of the present invention, the following examples are given. It should be noted that the examples provided are not to be read as limiting or defining the scope of the invention.

Figure 1:
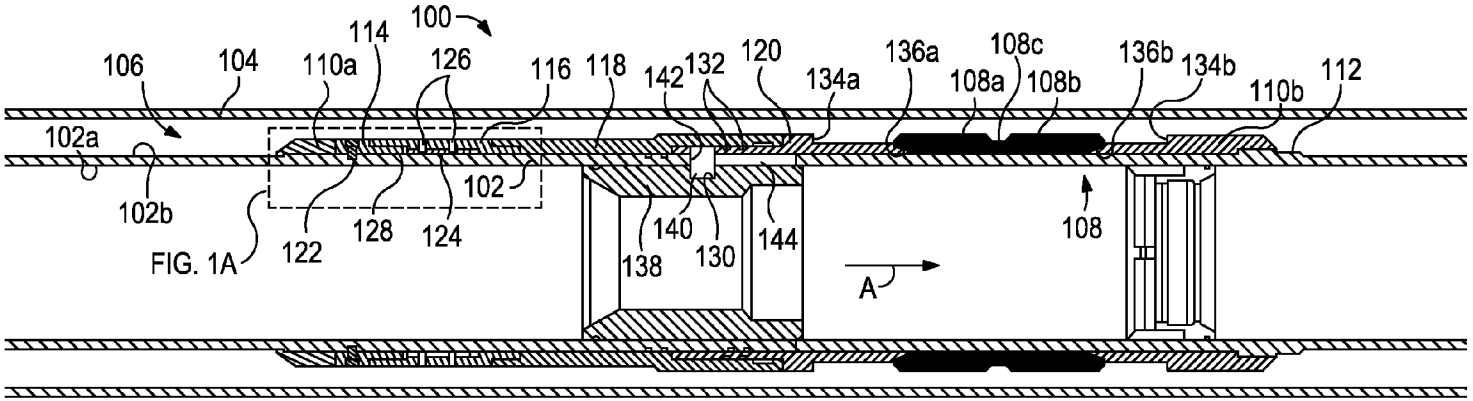
FIG. 1 illustrates a cross-sectional view of an exemplary downhole system, according to one or more embodiments disclosed.

Referring to FIG. 1, illustrated is a cross-sectional view of an exemplary downhole system 100 configured to seal a wellbore annulus, according to one or more embodiments. The system 100 may include a base pipe 102 extending within a casing 104 that has been cemented in a wellbore (not shown) drilled into the Earth's surface in order to penetrate various earth strata containing hydrocarbon formations. The system 100 is not limited to any specific type of well, but rather may be used in all types, such as vertical wells, horizontal wells, multilateral (e.g., slanted) wells, combinations thereof, and the like. An annulus 106 may be defined between the casing 104 and the base pipe 102. The casing 104 forms a protective lining within the wellbore and may be made from materials such as metals, plastics, composites, or the like. In at least one embodiment, the casing 104 may be omitted and the annulus 106 may instead be defined between the inner wall of the wellbore itself and the base pipe 102.

The base pipe 102 may be coupled to or form part of production tubing. In some embodiments, the base pipe 102 may include one or more tubular joints, having metal-to-metal threaded connections or otherwise threadedly joined to form a tubing string. In other embodiments, the base pipe 102 may form a portion of a coiled tubing. The base pipe 102 may have a generally tubular shape, with an inner radial surface 102*a* and an outer radial surface 102*b* having substantially concentric and circular cross-sections. However, other configurations may be suitable, depending on particular conditions and circumstances. For example, some configurations of the base pipe 102 may include offset bores, sidepockets, etc. The base pipe 102 may include portions formed of a non-uniform construction, for example, a joint of tubing having compartments, cavities or other components therein or thereon. In some embodiments, at least a portion of the base pipe 102 may be profiled or otherwise characterized as a mandrel-type device or structure.

As illustrated, the system 100 may include at least one packer 108 disposed about the base pipe 102. The packer 108 may be disposed about the base pipe 102 in a number of ways. For example, in some embodiments the packer 108 may directly or indirectly contact the outer radial surface 102*b* of the base pipe 102. In other embodiments, however, the packer 108 may be arranged about or otherwise radially-offset from another component of the base pipe 102. The packer 108 may include a first packer element 108*a* and a second packer element 108*b*, having a spacer 108*c* interposing the first and second packer elements 108*a,b*. As will be described in more detail below, the packer 108 may be configured to be compressed radially outward when subjected to axial compressive forces, thereby sealing the annulus in one or more locations.

The system 100 may further include an upper shoe 110*a* and a lower shoe 110*b* coupled to and extending about the base pipe 102. The upper and lower shoes 110*a,b* may be configured to axially bound the various components of the system 100 arranged about the outer surface 102*b* of the base pipe 102. In one or more embodiments, the lower shoe 110*b* may form an integral part of the base pipe 102, such that it serves as a mandrel-type device that helps compress the packer 108 during operation. In other embodiments, as illustrated, the lower shoe 110*b* may bias against a shoulder 112 defined on the base pipe 102, such that the lower shoe 110*b* is substantially prevented from moving axially to the right, as indicated by arrow A.

Figure 1A:
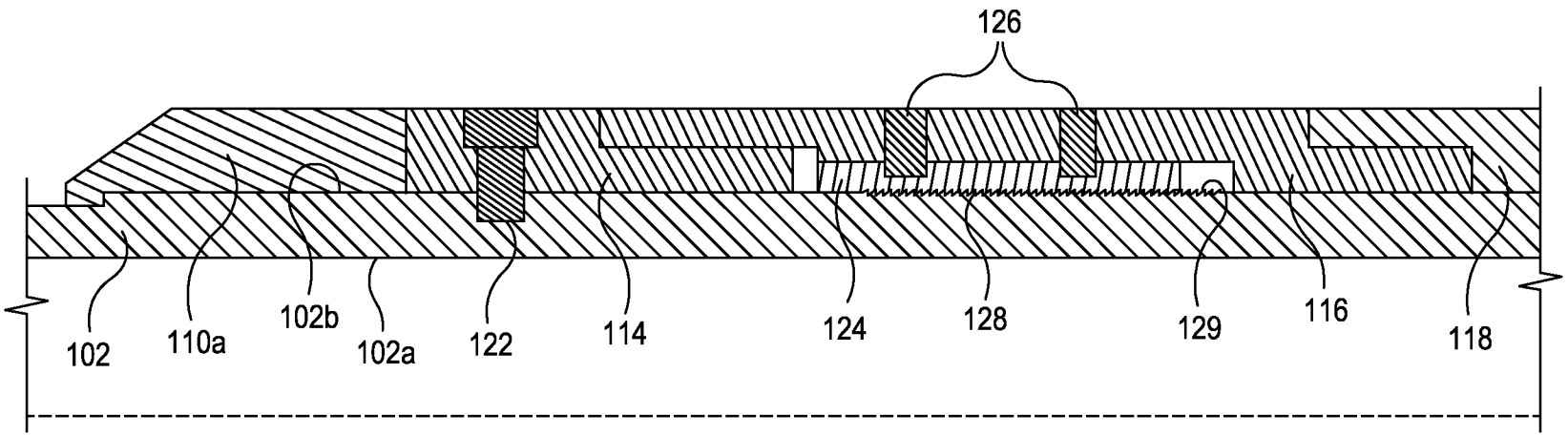
FIG. 1A illustrates a cross-sectional side view of an enlarged portion of FIG. 1.

With continued reference to FIG. 1, and additional reference to FIG. 1A, which provides an enlarged view of an indicated portion of FIG. 1, the system 100 may further include a shear ring 114, a lock ring housing 116, a guide sleeve 118, and a piston 120. The shear ring 114 may be arranged axially adjacent the upper shoe 110*a* and adapted to house one or more shear pins 122. The shear pins 122 may extend partially into the base pipe 102 in order to maintain the components of the system 100 arranged about the outer radial surface 102*b* in their axial placement until properly actuated. In some embodiments, eight shear pins 122 are employed and spaced about the outer radial surface 102*b* of the base pipe 102. As will be appreciated, however, more or less than eight shear pins 122 may be employed, without departing from the scope of the disclosure.

The lock ring housing 116 may be arranged axially adjacent the shear ring 114 and may house a lock ring 124 therein. In some embodiments, the lock ring housing 116 may be threaded onto the shear ring 114 and therefore able to move axially therewith. The lock ring 124 may be coupled or otherwise secured to the lock ring housing 116 using one or more lock pins 126. In other embodiments, however, the lock ring housing 116 may be threaded onto the lock ring 124, without departing from the scope of the disclosure.

In one or more embodiments, the lock ring 124 may define a plurality of ramped locking teeth 128. In operation, the lock ring 124 may be configured to slidingly engage the outer surface 102*b* of the base pipe 102 as the system 100 moves axially in the direction A. As the lock ring 124 translates axially, the ramped locking teeth 128 may be configured to engage corresponding teeth or grooves 129 defined on the outer surface 102*b* of the base pipe 102, thereby locking the lock ring 124 in its advanced axial position and generally preventing the system 100 from returning in the opposing axial direction.

The guide sleeve 118 may be arranged axially adjacent the lock ring housing 116 and configured to interpose or otherwise connect the lock ring housing 116 to the piston 120. In some embodiments, the guide sleeve 118 may be threaded onto both the lock ring housing 116 and the piston 120. One or more sealing components 132 may be configured to seal the radial engagement between the piston 120 and the guide sleeve 118. In some embodiments, the sealing components 132 may be o-rings. In other embodiments, the sealing components 132 may be other types of seals known to those skilled in the art.

The piston 120 may include a piston biasing shoulder 134*a* and a piston ramp 136*a*. The piston ramp 136*a* may be arranged axially adjacent the first packer element 108*a* and configured to slidingly engage the first packer element 108*a* as the packer 108 is being set. Likewise, the lower shoe 110*b* may define a mandrel biasing shoulder 134*b* and a mandrel ramp 136*b* arranged axially adjacent the second packer element 108*b*. The mandrel ramp 136*b* may be configured to slidingly engage the second packer element 108*b* as the packer 108 is being set.

The system 100 may further include an opening seat 138 axially movable and arranged within the base pipe 102. The opening seat 138 may be disposed against the inner radial surface 102*a* of the base pipe 102 and secured in its axial position therein using one or more setting pins 140. Although only one setting pin 140 is shown in FIG. 1, it will be appreciated that any number of setting pins 140 may be used without departing from the scope of the disclosure. In at least one embodiment, five setting pins 140 may be employed in order to secure the opening seat 138 in its axial position within the base pipe 102.

The setting pins 140 may be spaced circumferentially about the inner radial surface 102*a* of the base pipe 102. The setting pins 140 may extend through an axially elongate orifice 144 defined in the base pipe 102 in order to structurally couple the opening seat 138 to the piston 120. For example, the setting pins 140 may extend between corresponding holes 142 defined in the piston 120 and corresponding holes 130 defined in the opening seat 138. In some embodiments, the setting pins 140 are threaded into the holes 142, 130. In other embodiments, however, the setting pins 140 are attached to the piston 120 and/or the opening seat 138 by welding, brazing, adhesives, combinations thereof, or other attachment means.

In response to an axial force applied to the opening seat 138 in the direction A, the setting pins 140 may be correspondingly forced to translate axially within the elongate orifice 144, thereby also forcing the piston 120 to translate in the direction A. However, as a result of the connective combination of the piston 120, the guide sleeve 118, the lock ring, 116, and the shear ring 114, the setting pins 140 are prevented from axially translating while the one or more shear pins 122 are intact or otherwise engaged with the base pipe 102.

Figure 2:
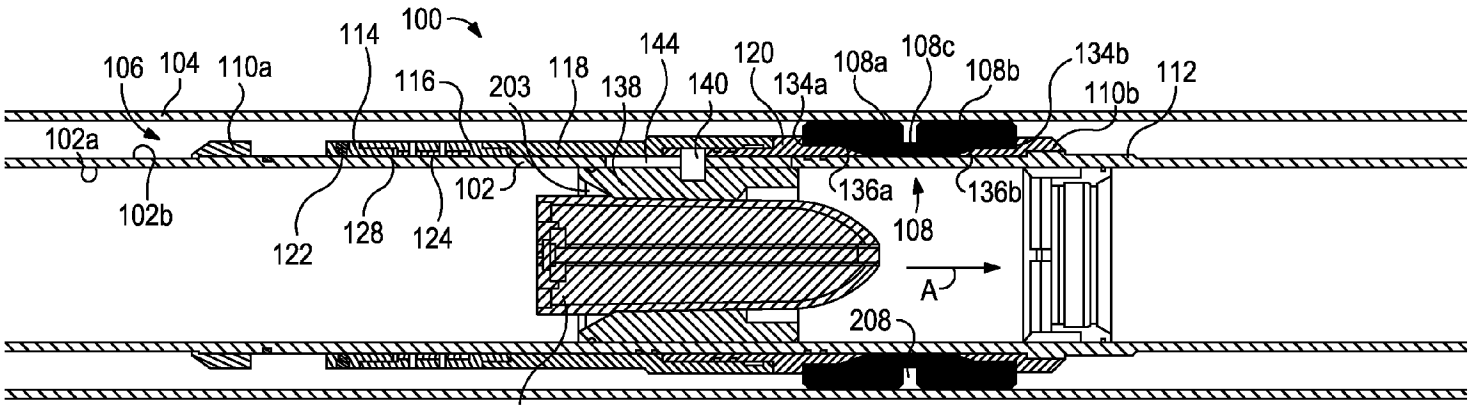
FIG. 2 illustrates a cross-sectional view of the downhole system of FIG. 1 in an actuated configuration, according to one or more embodiments disclosed.

Referring now to FIG. 2, illustrated is the exemplary downhole system 100 in a compressed configuration or otherwise where the packer 108 has been properly set, according to one or more embodiments. In exemplary operation of the system 100, a wellbore device 202 may be introduced into the well, within the base pipe 102, and configured to engage and move the opening seat 138 in the direction A. In at least one embodiment, the wellbore device 202 is a plug, as known by those skilled in the art. In other embodiments, however, the wellbore device 202 may be another type of downhole device such as, but not limited to, a ball or a dart. In some embodiments, the wellbore device 202 may be configured to engage a profiled portion 203 defined on an upper end of the opening seat 138. In other embodiments, however, the wellbore device 202 may be configured to engage any portion of the opening seat 138, without departing from the scope of the disclosure.

Once the wellbore device 202 engages the opening seat 138, a predetermined axial force in the direction A may be applied to the upper end of the wellbore device 202 in order to convey a corresponding axial force to the opening seat 138 and the one or more setting pins 140 coupled thereto. In some embodiments, the predetermined axial force may be applied to the wellbore device 202 by increasing fluid pressure within the base pipe 102. For instance, the wellbore device 202 may be adapted to sealingly engage the opening seat 138 or otherwise substantially seal against the inner radial surface 102*a* of the base pipe 102 such that a fluid pumped from the surface hydraulically forces the wellbore device 202 against the opening seat 138. Increasing the fluid pressure within the base pipe 102 correspondingly increases the axial force applied by the wellbore device 202 on the opening seat 138, and therefore increases the axial force applied to piston 120 via the setting pins 140. Further increasing the fluid pressure within the base pipe 102 may serve to shear the shear pin(s) 122 and thereby allow the opening seat 138 and piston 120 to axially translate in the direction A.

In one or more embodiments, the predetermined axial force required to shear the shear pins 122 and thereby move the opening seat 138 and setting pins 140 in the direction A may be about 500 psi. In other embodiments, however, the predetermined axial force may be more or less than 500 psi, without departing from the scope of the disclosure. As will be appreciated, in other embodiments the predetermined axial force may be applied to the opening seat 138 in other ways, such as a mechanical force applied to the wellbore device 202 which transfers its force to the opening seat 138.

As the opening seat 138 translates axially in the direction A, and the setting pins 140 translate within the elongate orifice 144, the piston 120 is correspondingly forced to translate axially and into increased contact and interaction with the packer 108. In particular, the first packer element 108*a* may slidably engage and ride up the piston ramp 136*a* until coming into contact with the piston biasing shoulder 134*a*. Likewise, the second packer element 108*b* may slidably engage and ride up the mandrel ramp 136*b* until coming into contact with the mandrel biasing shoulder 134*b*. Upon engaging the respective biasing shoulders 134*a,b*, and with continued axial movement in direction A, the first and second packer elements 108*a,b* may be compressed and extend radially to engage the inner wall of the casing 104. In one or more embodiments, the system 100 is prevented from reversing direction, and thereby decreasing the radial compression of the packer 108, by the ramped locking teeth 128 (FIG. 1A) that engage corresponding teeth or grooves (FIG. 1A) defined on the outer surface 102*b* of the base pipe 102. It will be appreciated, however, that other means of securing the system 100 in its compressed configuration may be used, without departing from the scope of the disclosure.

Accordingly, compressing the packer 108 between the piston 120 and the lower shoe 110*b* serves to effectively isolate or otherwise seal portions of the annulus 106 above and below the packer 108. As illustrated, the packer 108 may be configured to form a first seal 204 within the annulus 106 where the first packer element 108*a* seals against the inner wall of the casing 104. Likewise, a second seal 206 may be formed in the annulus 106 where the second packer element 108*b* seals against the inner wall of the casing 104. In operation, the first and second seals 204, 206 may be configured to substantially prevent fluid migration between the upper and lower portions of the annulus 106.

As the first and second seals 204, 206 are generated, a cavity 208 may be formed between the compressed first and second packer elements 108*a,b* and extending axially across the spacer 108*c*. The first and second packer elements 108*a,b* trap fluid within the cavity 208 and as the elements 108*a,b* are further compressed axially, the elastomeric material of each element 108*a,b* may compress the cavity 208 and thereby increase the fluid pressure therein. Accordingly, a third seal 210 may be generated within the cavity 208 and characterized as a hydraulic seal.

In at least one embodiment, a predetermined axial force of about 500 psi, as applied to the wellbore device 202 and correspondingly transferred to the piston 120 through the interconnection with the opening seat 138, may result in a fluid pressure generated in the cavity 208 of about 10,000 psi or more. In other embodiments, pressures greater or less than 10,000 psi may be obtained within the cavity 208, without departing from the scope of the disclosure. The increased pressures of the hydraulic third seal 210 may help the packer 108 prevent or otherwise entirely eliminate the migration of fluids (e.g., gases) through the packer 108.

Figure 3:
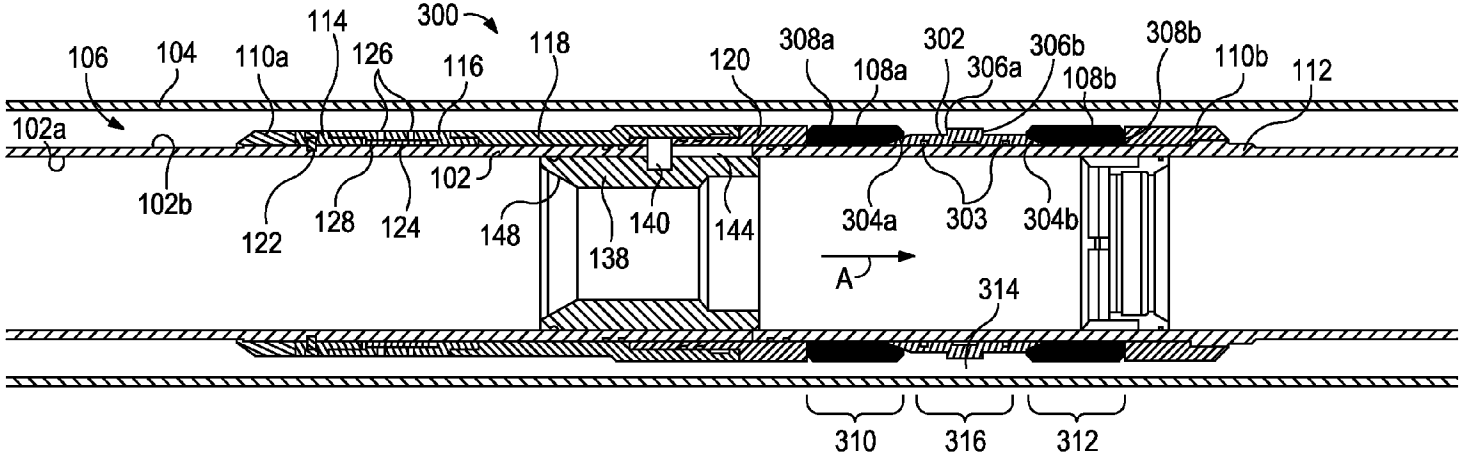
FIG. 3 illustrates a cross-sectional view of another exemplary downhole system, according to one or more embodiments disclosed.

Referring now to FIG. 3, illustrated is another exemplary downhole system 300 configured to seal a wellbore annulus, according to one or more embodiments. The downhole system 300 may be similar in several respects to the downhole system 100 described above with reference to FIGS. 1 and 2, and therefore may be best understood with reference thereto, where like numerals indicate like components that will not be described again in detail. As illustrated, the system 300 may include a ramped collar 302 slidably arranged about the base pipe 102 and interposing the first and second packer elements 108*a,b*. The ramped collar may include one or more sealing components 303 configured to seal the sliding engagement between the ramped collar 302 and the base pipe 102. In some embodiments, the sealing components 303 may be o-rings. In other embodiments, however, the sealing components 303 may be other types of seals known to those skilled in the art.

The ramped collar 302 may further include a first ramp 304*a* and an opposing second ramp 304*b*, and a first biasing shoulder 306*a* and an opposing second biasing shoulder 306*b*. The piston 120 may define or otherwise provide a square piston shoulder 308*a* juxtaposed against the first packer element 108*a*. Likewise, the lower shoe 110*b* may define or otherwise provide a square mandrel shoulder 308*b* juxtaposed against the second packer element 108*b*. Axial translation of the piston 120 in the direction A in FIG. 3, as well as in one or more of the embodiments discussed below, may be realized in a manner substantially similar to the axial translation of the piston 120 as discussed above with reference to FIGS. 1 and 2, and therefore will not be discussed again in detail.

The first ramp 304*a* may be arranged axially adjacent the first packer element 108*a* and configured to slidably engage the first packer element 108*a* as the square piston shoulder 308*a* pushes the first packer element 108*a* axially in the direction A. Likewise, the second ramp 304*b* may be arranged axially adjacent the second packer element 108*b* and configured to slidably engage the second packer element 108*b* as the ramped collar 302 translates axially in the direction A and the square mandrel shoulder 308*b* prevents the second packer element 108*b* from moving in direction A.

Further axial movement of the piston 120 in direction A forces the first and second packer elements 108*a,b* into engagement with the first and second biasing shoulders 306*a, b*, respectively. Upon engaging the respective biasing shoulders 306*a,b*, and with continued axial movement in direction A, the first and second packer elements 108*a,b* are compressed and extend radially to engage the inner wall of the casing 104. As a result, the first packer element 108*a* may be configured to form a first seal 310 where the first packer element 108*a* engages the inner wall of the casing 104, and the second packer element 108*b* may form a second seal 312 where the second packer element 108*b* engages the inner wall of the casing 104.

As the first and second seals 310, 312 are generated, a cavity 314 may be formed between the first and second packer elements 108*a,b* and extending axially across a portion of the ramped collar 302. The first and second packer elements 108*a,b* trap fluid within the cavity 314 and as the elements 108*a,b* are further compressed axially, the elastomeric material of each element 108*a,b* may compress the cavity 314 and thereby increase the fluid pressure therein. Accordingly, a third seal 316 may be generated within the cavity 314 and characterized as a hydraulic seal, similar to the third seal 210 described above with reference to FIG. 2. It should be noted that the seals 310, 312, and 316 shown in FIG. 3 are not depicted as compressed against the casing 104 as described above, but instead their general location is indicated.

Figure 4:
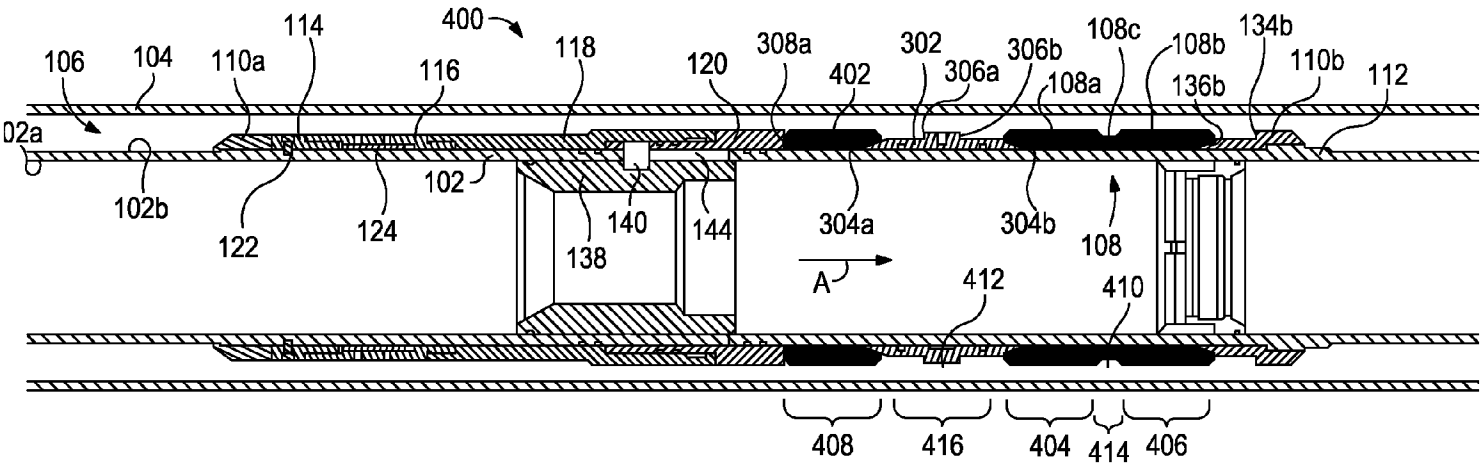
FIG. 4 illustrates a cross-sectional view of another exemplary downhole system, according to one or more embodiments disclosed.

Referring now to FIG. 4, illustrated is another exemplary downhole system 400 configured to seal a wellbore annulus, according to one or more embodiments. The downhole system 400 may be similar in several respects to the downhole systems 100 and 300 described above with reference thereto, and therefore may be best understood with reference to FIGS. 1-3, where like numerals indicate like components that will not be described again in detail. As illustrated, the system 400 includes the ramped collar 302 interposing the packer 108 and a third packer element 402. Specifically, the first ramp 304*a* may be arranged axially adjacent the third packer element 402 and configured to slidably engage the third packer element 402 as it is pushed axially in direction A by the square piston shoulder 308*a*. The second ramp 304*b* may be arranged axially adjacent the first packer element 108*a* and configured to slidably engage the first packer element 108*a* as the ramped collar 302 translates axially in the direction A. The mandrel ramp 136*b* of the lower shoe 110*b* may be arranged axially adjacent the second packer element 108*b* and configured to slidingly engage the second packer element 108*b* as the packer 108 is being set.

Further axial movement of the piston 120 in direction A forces the third packer element 402 into engagement with the first biasing shoulder 306*a*, the first packer element 108*a* into engagement with the second biasing shoulder 306*b*, and the second packer element 108*b* into engagement with the mandrel biasing shoulder 134*b*. Upon engaging the respective shoulders 306*a,b*, 134*b*, and with continued axial force in direction A, the third, first, and second packer elements 402, 108*a,b* are compressed and extend radially to engage the inner wall of the casing 104. As a result, the first, second, and third packer elements 108*a,b*, 402 form first, second, and third seals 404, 406, 408, respectively, at the location where each engages the inner wall of the casing 104.

Moreover, as the first, second, and third seals 404, 406, 408 are generated, a first cavity 410 may be formed between the first and second packer elements 108*a,b* and extending axially across the spacer 108*c*, and a second cavity 412 may be formed between the first and third packer elements 108*a*, 402 and extending axially across a portion of the ramped collar 302. The compressed packer elements 108*a,b*, 402 trap fluid within the respectively formed cavities 410, 412 and as the packer elements 108*a,b*, 402 are further compressed axially, the fluid pressure in each cavity 410, 412 increases to provide a hydraulic third seal 414 and a hydraulic fourth seal 416, similar to the third seal 210 described above with reference to FIG. 2. It should be noted that the seals 404, 406, 408, 414, and 416 shown in FIG. 4 are not depicted as compressed against the casing 104 as described above, but instead their general location is indicated.

Figure 5:
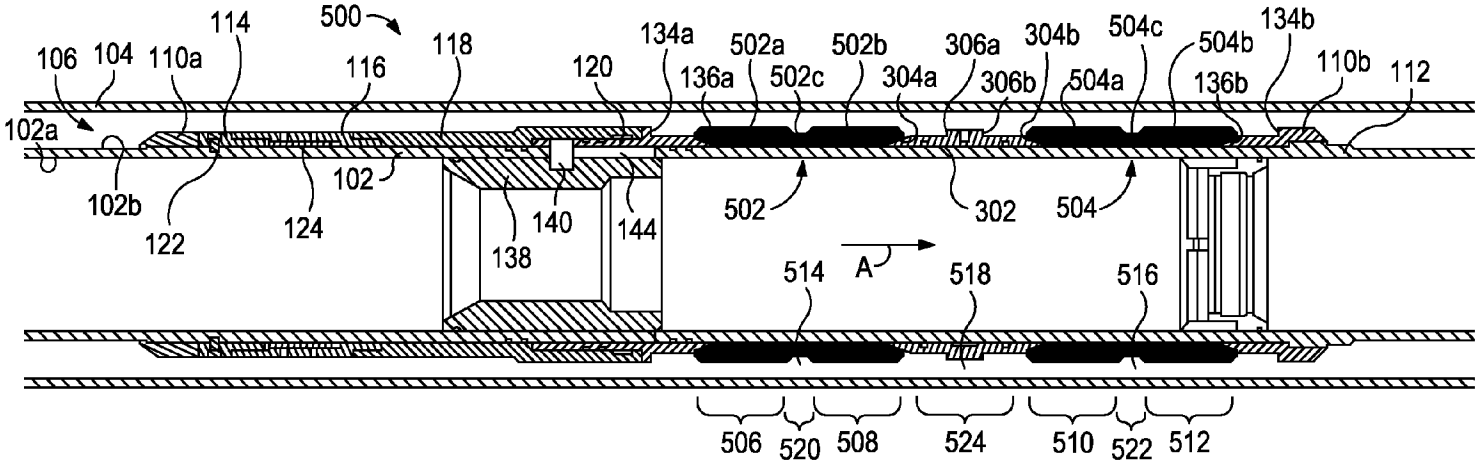
FIG. 5 illustrates a cross-sectional view of another exemplary downhole system, according to one or more embodiments disclosed.

Referring now to FIG. 5, illustrated is another exemplary downhole system 500 configured to seal a wellbore annulus, according to one or more embodiments. The downhole system 500 may be similar in several respects to the downhole systems 100 and 300 described above with reference to FIGS. 1-3, and therefore may be best understood with reference thereto, where like numerals indicate like components that will not be described again in detail. As illustrated, the system 500 includes a first packer 502 and a second packer 504 axially spaced from each other and disposed about the base pipe 102. The first packer 502 may include a first packer element 502*a* and a second packer element 502*b*, having a spacer 502*c* interposing the first and second packer elements 502*a,b*. The second packer 504 may include a third packer element 504*a* and a fourth packer element 504*b*, having a spacer 504*c* interposing the third and fourth packer elements 504*a,b*.

The system 500 may further include the ramped collar 302 arranged between the first and second packers 502, 504. Specifically, the first ramp 304*a* may be arranged axially adjacent and slidably engaging the second packer element 502*b* and the second ramp 304*b* may be arranged axially adjacent and slidably engaging the third packer element 504*a*. Moreover, the first packer element 502*a* may be arranged axially adjacent and slidably engaging the piston ramp 136*a* and the fourth packer element 504*b* may be arranged axially adjacent and slidably engaging the mandrel ramp 136*b*. As the piston 120 translates axially in the direction A, the first packer element 502*a* eventually engages the piston biasing shoulder 134*a*, which forces the second packer element 502*b* into contact with the first biasing shoulder 306*a* and thereby moves the ramped collar 302. Axial movement of the ramped collar 302 in the direction A allows the third packer element 504*a* to contact the second biasing shoulder 306*b* and the fourth packer element 504*b* to contact the mandrel biasing shoulder 134*b*.

Upon engaging the respective shoulders 134*a,b*, 306*a,b*, and with continued axial force in direction A, the first, second, third and fourth packer elements 502*a,b*, 504*a,b*, are compressed and extend radially to engage the inner wall of the casing 104. As a result, the first, second, third and fourth packer elements 502*a,b*, 504*a,b* form first, second, third, and fourth seals 506, 508, 510, 512, respectively, at the location where each engages the inner wall of the casing 104.

As the first, second, third, and fourth seals 506, 508, 510, 512 are generated, a first cavity 514 may be formed between the first and second packer elements 502*a,b* and extending axially across the spacer 502*c*, a second cavity 516 may be formed between the third and fourth packer elements 504*a,b* and extending axially across the spacer 504*c*, and a third cavity 518 may be formed between the second and third packer elements 502*b*, 504 and extending axially across a portion of the ramped collar 302. Increased compression of the first, second, third, and fourth packer elements 502*a,b*, 504*a,b* increases the fluid pressure within the first, second, and third cavities 514, 516, 518, thereby forming fifth, sixth, and seventh seals 520, 522, 524, respectively, each characterized as hydraulic seals similar to the third seal 210 described above with reference to FIG. 2. It should be noted that the seals 506, 508, 510, 512, 520, 522, and 524 shown in FIG. 5 are not depicted as compressed against the casing 104 as described above, but instead their general location is indicated.

Figure 6:
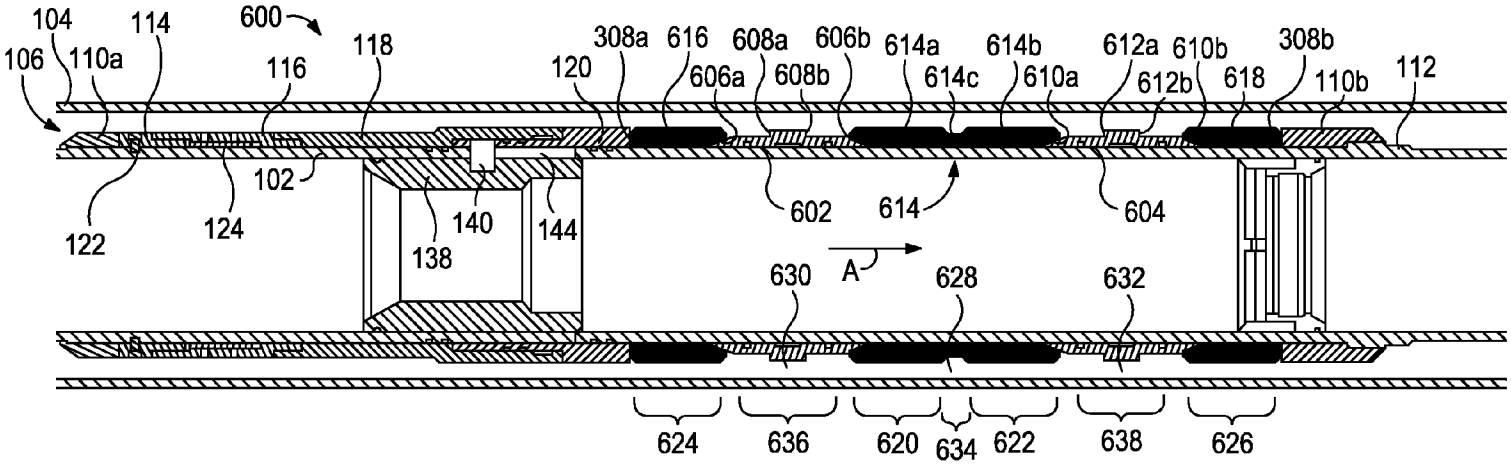
FIG. 6 illustrates a cross-sectional view of another exemplary downhole system, according to one or more embodiments disclosed.

Referring now to FIG. 6, illustrated is another exemplary downhole system 600 configured to seal a wellbore annulus, according to one or more embodiments. The downhole system 600 may be similar in several respects to the downhole systems 100 and 300 described above with reference to FIGS. 1-3, and therefore may be best understood with reference thereto, where like numerals indicate like components that will not be described again in detail. As illustrated, the system 600 includes a first ramped collar 602 and a second ramped collar 604 slidably arranged about the base pipe 102. The first and second ramped collars 602, 604 may be similar to the ramped collar 302 described above with reference to FIG. 3. Specifically, the first ramped collar 602 may include a first ramp 606*a* and an opposing second ramp 606*b*, and a first biasing shoulder 608*a* and an opposing second biasing shoulder 608*b*. Moreover, the second ramped collar 604 may include a third ramp 610*a* and an opposing fourth ramp 610*b*, and a third biasing shoulder 612*a* and an opposing fourth biasing shoulder 612*b*.

A packer 614 having a first packer element 614*a* and a second packer element 614*b* may interpose the first and second ramped collars 602, 604 such that the first packer element 614*a* slidably engages the second ramp 606*b* and the second packer element 614*b* slidably engages the third ramp 610*a*. As illustrated, the system 600 may further include a third packer element 616 and a fourth packer element 618 axially spaced from the packer 614 and arranged about the base pipe 102. The third packer element 616 may be configured to slidably engage the first ramp 606*a* and bias the square piston shoulder 308*a*, and the fourth packer element 618 may be configured to slidably engage the fourth ramp 610*b* and bias the square mandrel shoulder 308*b*.

As the piston 120 translates axially in the direction A, the square piston shoulder 308*a* forces the third packer element 616 into engagement with the first biasing shoulder 608*a*, which forces the first ramped collar 602 to likewise translate axially such that the first packer element 614*a* comes into contact with the second biasing shoulder 608*b*. Further axial movement of the first ramped collar 602 forces the packer 614 to translate axially until the second packer element 614*b* engages the third biasing shoulder 612*a*, which forces the second ramped collar 604 to translate axially such that the fourth packer element 618 comes into contact with the fourth biasing shoulder 612*b* as it is biased on its opposite end by the immovable square mandrel shoulder 308*b*. Upon engaging the respective shoulders 308*a,b*, 608*a,b*, and 612*a,b*, and with continued axial force in direction A, the first, second, third, and fourth packer elements 614*a,b*, 616, 618 are compressed and extend radially to engage the inner wall of the casing 104. As a result, the first, second, third, and fourth packer elements 614*a,b*, 616, 618 form first, second, third, and fourth seals 620, 622, 624, 626, respectively, at the location where each engages the inner wall of the casing 104.

As the first, second, third, and fourth seals 620, 622, 624, 626 are generated, a first cavity 628 may be formed between the first and second packer elements 614*a,b* and extend axially across the spacer 614*c*, a second cavity 630 may be formed between the third and first packer elements 616, 614*a* and extend axially across a portion of the first ramped collar 602, and a third cavity 632 may be formed between the second and fourth packer elements 614*b*, 618 and extend axially across a portion of the second ramped collar 604. Increased compression of the first, second, third, and fourth packer elements 614*a,b*, 616, 618 increases the fluid pressure within the first, second, and third cavities 628, 630, 632, thereby forming fifth, sixth, and seventh seals 634, 636, 638, respectively, each characterized as hydraulic seals similar to the third seal 210 described above with reference to FIG. 2. It should be noted that the seals 620, 622, 624, 626, 634, 636, and 638 shown in FIG. 6 are not depicted as compressed against the casing 104 as described above, but instead their general location is indicated.

Figure 7:
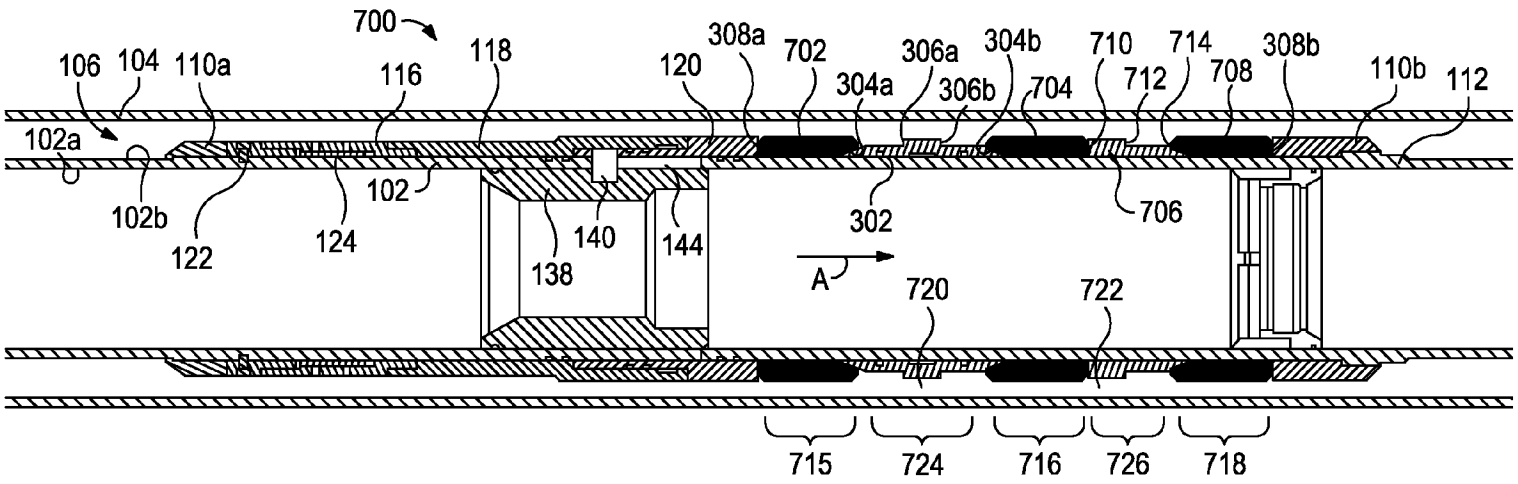
FIG. 7 illustrates a cross-sectional view of another exemplary downhole system, according to one or more embodiments disclosed.

Referring now to FIG. 7, illustrated is another exemplary downhole system 700 configured to seal a wellbore annulus, according to one or more embodiments. The downhole system 700 may be similar in several respects to the downhole systems 100 and 300 described above with reference to FIGS. 1-3, and therefore may be best understood with reference thereto, where like numerals indicate like components that will not be described again in detail. As illustrated, the system 700 includes the ramped collar 302 interposing a first packer element 702 and a second packer element 704 such that the first ramp 304*a* slidably engages the first packer element 702 and the second ramp 304*b* slidably engages the second packer element 704.

The system 700 may further include a shoulder ramp 706 interposing the second packer element 704 and a third packer element 708. The shoulder ramp 706 may be axially offset from the ramp collar 302 and disposed about the base pipe 102. Moreover, the shoulder ramp 706 may include a square shoulder 710, an opposing biasing shoulder 712, and a third ramp 714, where the square shoulder 710 biases the second packer element 704 and the third ramp 714 slidably engages the third packer element 708.

As the piston 120 translates axially in direction A, the square piston shoulder 308*a* forces the first packer element 702 into engagement with the first biasing shoulder 306*a*, which forces the ramped collar 302 to likewise translate axially such that the second packer element 704 comes into contact with the second biasing shoulder 306*b*. Further axial movement of the ramped collar 302, in conjunction with the immovable square mandrel shoulder 308*b*, forces the shoulder ramp 706 to likewise translate axially until the third packer element 708 comes into contact with the biasing shoulder 712 of the shoulder ramp 706. Upon engaging the respective shoulders 308*a,b*, 306*a,b*, 710, and 712, and with continued axial force in direction A, the first, second, and third packer elements 702, 704, 708 are compressed and extend radially to engage the inner wall of the casing 104. As a result, the first, second, and third packer elements 702, 704, 708 form first, second, and third seals 715, 716, 718, respectively, at the location where each engages the inner wall of the casing 104.

As the first, second, and third seals 715, 716, 718 are generated, a first cavity 720 may be formed between the first and second packer elements 702, 704 and extend axially across a portion of the ramped collar 302, and a second cavity 722 may be formed between the second and third packer elements 704, 708 and extend axially across a portion of the shoulder ramp 706. Increased compression of the first, second, and third packer elements 702, 704, 708 increases the fluid pressure within the first and second cavities 720, 722, thereby forming fourth and fifth seals 724, 726, respectively, each characterized as hydraulic seals similar to the third seal 210 described above with reference to FIG. 2. It should be noted that the seals 715, 716, 718, 724, and 726 shown in FIG. 7 are not depicted as compressed against the casing 104 as described above, but instead their general location is indicated.

Figure 8:
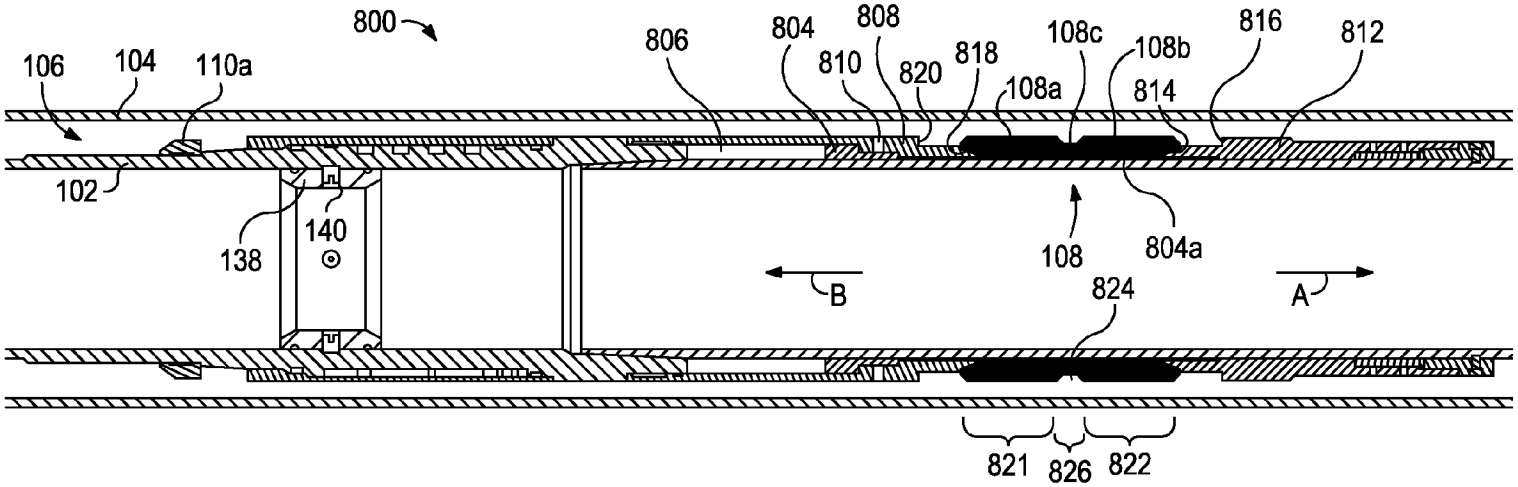
FIG. 8 illustrates a cross-sectional view of another exemplary downhole system, according to one or more embodiments disclosed.

Referring now to FIG. 8, illustrated is another exemplary downhole system 800 configured to seal a wellbore annulus, according to one or more embodiments. The downhole system 800 may be similar in several respects to the downhole systems 100 and 300 described above with reference to FIGS. 1-3, and therefore may be best understood with reference thereto, where like numerals indicate like components that will not be described again in detail. The downhole system 800 may be configured to compress the packer 108 and seal the annulus 106 using hydrostatic pressure. As illustrated, the system 800 may include a hydrostatic piston 804 housed within a hydrostatic chamber 806. The hydrostatic chamber 806 may be at least partially defined by a retainer element 808 arranged about the base pipe 102. One or more inlet ports 810 may be defined in the retainer element 808 and thereby provide fluid communication between the annulus 106 and the hydrostatic chamber 806.

The piston 804 may include a stem portion 804*a* that extends axially from the piston 804 and interposes the packer 108 and the base pipe 102. The stem portion 804*a* may be coupled to compression sleeve 812 having a sleeve ramp 814 and a sleeve shoulder 816. The hydrostatic chamber 806 may contain fluid under hydrostatic pressure from the annulus 106, and the hydrostatic piston 804 remains in fluid equilibrium until a pressure differential is experienced across the hydrostatic piston 804, at which point the piston 804 translates axially in a direction B within the hydrostatic chamber 806 as it seeks pressure equilibrium once again.

As the hydrostatic piston 804 translates in direction B, the compression sleeve 812 coupled to the stem portion 804*a* is forced toward the second packer element 108*b* and the second packer element 108*b* rides up the sleeve ramp 814 and biases the sleeve shoulder 816. Likewise, the first packer element 108*a* may ride up a retainer ramp 818 and bias a retainer shoulder 820, each being defined on the retainer element 808. As a result the packer is compressed radially and seals against the inner wall of the casing 104.

The hydrostatic piston 804 may be actuated by introducing the wellbore device 202 (FIG. 2) into the base pipe 102 and moving the opening seat 138 in the direction A, as generally described above. Moving the opening seat 138 in direction A may trigger high pressure formation or wellbore fluids from the annulus 106 to enter the hydrostatic chamber 806 via the one or more inlet ports 810 defined in the retainer element 808. As the hydrostatic piston 804 attempts to regain hydrostatic equilibrium, it will move axially in direction B, thereby compressing the packer 108 to form a first seal 821 within the annulus 106 where the first packer element 108*a* seals against the inner wall of the casing 104. Likewise, a second seal 822 may be formed in the annulus 106 where the second packer element 108*b* seals against the inner wall of the casing 104.

As the first and second seals 821, 822 are generated, a cavity 824 may be formed between the compressed first and second packer elements 108*a,b* and extending axially across the spacer 108*c*. Increased compression of the first and second packer elements 108*a,b* increases the fluid pressure within the cavity 824, thereby forming a third seal 826, characterized as a hydraulic seal similar to the third seal 210 described above with reference to FIG. 2. It should be noted that the seals 821, 822, and 826 shown in FIG. 8 are not depicted as compressed against the casing 104 as described above, but instead their general location is indicated.

It will be appreciated that the various components of each system 100, 300-800 may be mixed, duplicated, rearranged, combined with components of other systems 100, 300-800, or otherwise altered in various axial configurations in order to fit particular wellbore applications. Accordingly, the disclosed systems 100, 300-800 and related methods may be used to remotely set one or more packers or packer elements. Setting the packer elements not only provides corresponding seals against the inner wall of the wellbore, but also creates hydraulic seals between adjacent packer elements. Because these hydraulic seals pressurize a trapped fluid, they exhibit an increased pressure threshold and therefore an enhanced ability to prevent the migration of fluids therethrough. Consequently, the annulus 106 is better sealed on either side of each hydraulic seal.

A method for sealing a wellbore annulus is also disclosed herein. In some embodiments, the method may include engaging an opening seat with a wellbore device. The opening seat may be movably arranged within a base pipe having inner and outer radial surfaces and defining an elongate orifice. The opening seat may further include a setting pin coupled thereto and extending radially through the elongate orifice. The method may also include applying a predetermined axial force on the opening seat with the wellbore device and thereby axially moving the opening seat and the setting pin in a first direction, and moving in the first direction a piston arranged on the outer radial surface. The piston may be coupled to the setting pin such that axial translation of the opening seat correspondingly moves the piston. The piston may also define or otherwise provide a piston biasing shoulder. The method may further include engaging and compressing a first packer element with the piston biasing shoulder and thereby forming a first seal within the wellbore annulus, and engaging and compressing a second packer element with a mandrel biasing shoulder and thereby forming a second seal within the wellbore annulus. The method may further include forming a hydraulic seal in a cavity defined between the first and second seals.

In some embodiments, applying the predetermined axial force on the opening seat may include applying fluid pressure against the wellbore device. In some embodiments, the method may further include shearing one or more shear pins that secure the piston against axial translation in the first direction. The method may also include slidingly engaging the first packer element with a piston ramp defined by the piston, and slidingly engaging the second packer element with a mandrel ramp. In one or more embodiments, the method also includes engaging and further compressing the first packer element with a first shoulder defined on a ramped collar arranged about the base pipe and interposing the first and second packer elements, and further engaging and further compressing the second packer element with a second shoulder defined on the ramped collar. Axial movement of the piston in the first direction forces the first and second packer elements into engagement with the first and second biasing shoulders, respectively.

In some aspects, a system for sealing a wellbore annulus defined between a base pipe and a casing is disclosed. The system may include a piston arranged on an outer radial surface of the base pipe, the piston having a piston ramp and a piston biasing shoulder, a lower shoe extending about the outer radial surface and having a mandrel ramp and a mandrel biasing shoulder, and a packer disposed about the base pipe and interposing the piston and the lower shoe, the packer having a first packer element adjacent the piston and a second packer element adjacent the lower shoe, wherein as the piston axially translates the first and second packer elements are compressed against the piston and mandrel biasing shoulders, respectively, and the first packer element forms a first seal against the casing in the annulus and the second packer element forms a second seal against the casing in the annulus, and wherein the first and second seals define a cavity therebetween that traps fluid within the cavity and thereby provides a hydraulic seal.

In some aspects a method for sealing a wellbore annulus defined between a base pipe and a casing is disclosed. The method may include axially translating a piston arranged on an outer radial surface of a base pipe, the piston having a piston biasing shoulder, engaging and compressing a first packer element with the piston biasing shoulder and thereby forming a first seal against the casing within the wellbore annulus, engaging and compressing a second packer element with a mandrel biasing shoulder and thereby forming a second seal against the casing within the wellbore annulus, and forming a hydraulic seal in a cavity defined between the first and second seals.

In some aspects, a system for sealing a wellbore annulus defined between a base pipe and a casing is disclosed. The system may include a piston arranged on an outer radial surface of the base pipe, the piston having a piston biasing shoulder, a lower shoe extending about the outer radial surface and having a mandrel biasing shoulder, a first ramped collar arranged about the base pipe and interposing the piston and the lower shoe, the first ramped collar having a first ramp and an opposing second ramp, and a first biasing shoulder and an opposing second biasing shoulder, a first packer element disposed about the base pipe and arranged between the piston and the first ramped collar, and a second packer element disposed about the base pipe and arranged between the lower shoe and the first ramped collar, wherein as the piston axially translates the first and second packer elements are compressed against the piston and mandrel biasing shoulders, respectively, and the first packer element forms a first seal against the casing in the annulus and the second packer element forms a second seal against the casing in the annulus, and wherein the first and second seals define a cavity therebetween that traps fluid within the cavity and thereby provides a hydraulic seal.

In some aspects, a system for sealing a wellbore annulus defined between a base pipe and a casing is disclosed. The system may include a retainer element arranged about a base pipe and defining a hydrostatic chamber that houses a hydrostatic piston having a stem portion that extends axially, the retainer element having a retainer ramp and a retainer shoulder, a compression sleeve arranged about the base pipe and coupled to the hydrostatic piston via the stem element, the compression sleeve having a sleeve ramp and a sleeve shoulder, and first and second packer elements arranged about the base pipe and interposing the retainer element and the compression sleeve, the first packer element being adjacent the retainer element and the second packer element being adjacent the compression sleeve, wherein as the hydrostatic piston axially translates, it pulls the compression sleeve into contact with the second packer element and the retainer element into contact with the first packer element, and wherein the first and second packer elements are compressed and form first and second seals against the casing, respectively, in the annulus and further define a cavity therebetween, the cavity being configured to trap fluid therein and provide a hydraulic seal.

In the following description of the representative embodiments of the invention, directional terms, such as "above," "below," "upper," "lower," etc., are used for convenience in referring to the accompanying drawings. In general, "above," "upper," "upward," and similar terms refer to a direction toward the earth's surface along a wellbore, and "below," "lower," "downward" and similar terms refer to a direction away from the earth's surface along the wellbore.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended due to the details of construction or design herein shown, other than as described in the claims below. It is therefore evident that the particular illustrative embodiments disclosed above may be altered, combined, or modified and all such variations are considered within the scope and spirit of the present invention. In addition, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

What is claimed is:

1. A system for sealing a wellbore annulus, comprising:

a base pipe having inner and outer radial surfaces and defining an elongate orifice;

an opening seat movably arranged within the base pipe and having a setting pin extending radially from the opening seat and through the elongate orifice, the setting pin being axially translatable within the elongate orifice as the opening seat axially translates in a first direction;

a piston movably arranged on the outer radial surface and coupled to the setting pin such that axial translation of the opening seat correspondingly moves the piston, the piston having a piston biasing shoulder;

a lower shoe extending about the outer radial surface and having a mandrel biasing shoulder;

a packer disposed about the outer radial surface and interposing the piston and the lower shoe, the packer having a first packer element adjacent the piston and a second packer element adjacent the lower shoe;

a ramped collar arranged about the base pipe and interposing the first and second packer elements, the ramped collar having a first ramp and an opposing second ramp, and a first biasing shoulder and an opposing second biasing shoulder, wherein the first ramp is arranged axially adjacent the first packer element and the second ramp is arranged axially adjacent the second packer element; and a wellbore device disposable within the base pipe to engage and move the opening seat in the first direction and thereby axially compress the first and second packer elements against the piston and mandrel biasing shoulders, respectively, whereby the first packer element forms a first seal in the wellbore annulus and the second packer element forms a second seal in the wellbore annulus, wherein the first and second ramps transition radially outward to the first and second biasing shoulders, respectively, such that the first and second ramps extend radially below the first and second packer elements as the first and second packer elements are axially compressed, and wherein the first and second seals define a cavity therebetween that traps fluid therein and provides a hydraulic seal.

2. The system of claim 1, further comprising:

a piston ramp defined by the piston, the piston ramp being slidingly engaged with the first packer element; and a mandrel ramp defined by the lower shoe, the mandrel ramp being slidingly engaged with the second packer element.

3. The system of claim 1, further comprising:

an upper shoe disposed about the base pipe;

a shear ring axially offset from the upper shoe and disposed about the base pipe, the shear ring housing one or more shear pins that extend partially into the base pipe;

a lock ring housing coupled to the shear ring and housing a lock ring, the lock ring defining a plurality of ramped locking teeth; and a guide sleeve interposing and coupled to both the lock ring housing and the piston.

4. The system of claim 3, wherein the lock ring slidingly engages the outer surface of the base pipe as the piston axially translates, and the ramped locking teeth are adapted to engage corresponding teeth or grooves defined on the outer surface, thereby locking the lock ring and piston in their advanced axial position.

5. The system of claim 3, wherein the one or more shear pins prevent the piston from axially translating in the first direction until sheared by a force applied by the wellbore device to the opening seat.

6. The system of claim 1, wherein the wellbore device is a well plug.

7. The system of claim 1, wherein axial movement of the piston in the first direction forces the first and second packer elements into engagement with the first and second biasing shoulders, respectively.

8. The system of claim 1, further comprising one or more sealing components interposing the ramped collar and the base pipe to seal an engagement between the ramped collar and the base pipe.

9. The system of claim 1, wherein one or both of the piston biasing shoulder and the mandrel biasing shoulder are square shoulders.

10. A method for sealing a wellbore annulus, comprising:

engaging an opening seat with a wellbore device, the opening seat being movably arranged within a base pipe having inner and outer radial surfaces and defining an elongate orifice, the opening seat further having a setting pin coupled thereto and extending radially through the elongate orifice;

applying a predetermined axial force on the opening seat with the wellbore device and thereby axially moving the opening seat and the setting pin in a first direction;

moving a piston arranged on the outer radial surface in the first direction, the piston being coupled to the setting pin such that axial translation of the opening seat correspondingly moves the piston, wherein the piston has a piston biasing shoulder;

engaging and axially compressing a first packer element between the piston biasing shoulder and a ramped collar arranged about the base pipe;

engaging and axially compressing a second packer element between a mandrel biasing shoulder and the ramped collar, wherein the ramped collar interposes the first and second packer elements and provides a first ramp that transitions radially outward to a first biasing shoulder and a second ramp that transitions radially outward to a second biasing shoulder;

extending the first and second ramps radially below the first and second packer elements, respectively, as the first and second packer elements are axially compressed;

engaging the first and second packer elements against the first and second biasing shoulders, respectively, as the first and second packer elements are axially compressed and thereby forming first and second seals within the wellbore annulus; and forming a hydraulic seal in a cavity defined between the first and second seals.

11. The method of claim 10, wherein applying the predetermined axial force on the opening seat comprises applying fluid pressure against the wellbore device.

12. The method of claim 10, further comprising shearing one or more shear pins that secure the piston against axial translation in the first direction.

13. The method of claim 10, further comprising:

slidingly engaging the first packer element with a piston ramp defined by the piston; and slidingly engaging the second packer element with a mandrel ramp.

14. The method of claim 10, wherein forming a hydraulic seal in the cavity further comprises pressurizing the cavity.

* * * * *